US005949960A

United States Patent [19]

Hall

[11] Patent Number: 5,949,960

[45] Date of Patent: Sep. 7, 1999

[54] ELECTRIC WATER HEATER WITH DRY FIRE PROTECTION SYSTEM INCORPORATED THEREIN

[75] Inventor: Jacob H. Hall, Dadeville, Ala.

[73] Assignee: Rheem Manufacturing Company, New York, N.Y.

[21] Appl. No.: 08/898,508

[22] Filed: Jul. 21, 1997

[51] Int. Cl.[6] ..... F24H 1/20; H05B 3/02

[52] U.S. Cl. ..... 392/454; 392/455; 219/481

[58] Field of Search ..... 392/441, 449, 392/451, 454, 497, 498; 200/61.04, 61.08, 61.19, 61.2, 182, 190, 209; 219/487

[56] References Cited

U.S. PATENT DOCUMENTS

| | | | |
|---|---|---|---|
| 539,234 | 5/1895 | Neu . | |
| 2,392,635 | 1/1946 | Bletz | 219/37 |
| 2,533,614 | 12/1950 | Osterheld | 219/39 |
| 2,772,344 | 11/1956 | Bowen et al. | 219/38 |
| 3,025,383 | 3/1962 | Forsness, Jr. | 219/43 |
| 3,135,860 | 6/1964 | Czarnecki | 219/441 |
| 3,497,673 | 2/1970 | Wright | 219/328 |
| 3,767,894 | 10/1973 | Berger | 219/321 |
| 3,787,650 | 1/1974 | Lewis | 200/61.04 |
| 4,001,531 | 1/1977 | Crockett, Sr. | 200/61.04 |
| 4,037,080 | 7/1977 | Owen | 219/328 |
| 4,044,224 | 8/1977 | Jenkins et al. | 219/322 |
| 4,416,567 | 11/1983 | Murphy et al. | 219/336 |
| 4,455,477 | 6/1984 | Massey et al. | 219/328 |
| 4,730,099 | 3/1988 | Bleckman | 219/328 |
| 4,757,182 | 7/1988 | Albright | 219/314 |
| 5,335,311 | 8/1994 | Groothuizen | 392/457 |
| 5,437,002 | 7/1995 | Bennett | 392/441 |

OTHER PUBLICATIONS

Rheem/Ruud "Residential & Commercial Electric Water Heater Manual", Apr., 1996 (pp. 8 and 9).

*Primary Examiner*—Teresa Walberg
*Assistant Examiner*—Thor S Campbell
*Attorney, Agent, or Firm*—Konneker & Smith, P.C.

[57] ABSTRACT

Multiple resistance type electric heating elements projecting into the interior of the storage tank portion of an electric water heater are protected against dry firing damage by using a water soluble member, representatively a sugar cube, positioned in the empty tank and blocking the spring-driven movement of a switch closure member that maintains an electrical circuit in an open state preventing electrical current flow through any of the heating elements. When the tank is initially filled with water the sugar cube dissolves, thereby unblocking the switch closure member and permitting it to be spring-driven into a circuit closing position to permit electrical current flow through the heating elements.

46 Claims, 4 Drawing Sheets

ELECTRIC WATER HEATER WITH DRY FIRE PROTECTION SYSTEM INCORPORATED THEREIN

BACKGROUND OF THE INVENTION

The present invention generally relates to apparatus for heating liquids and, in a preferred embodiment thereof, more particularly relates to apparatus for providing dry fire protection for the resistance type heating elements in electric water heaters.

Water heaters used to heat and store a quantity of water in a tank structure for subsequent on-demand delivery to plumbing fixtures such as sinks, bathtubs and showers in both residences and commercial buildings typically utilize either a combustible fuel such as gas or oil, or one or more electric resistance heating elements, to supply heat to the tank-stored water under the control of a thermostat which monitors the temperature of the stored water. While over the years both of these types of water heaters have evolved into highly reliable heating devices capable of providing years of dependable service, in common with other types of heating equipment they must be installed properly to function as intended.

An electric water heater, like its fuel-fired counterparts, is sold without water in it and is filled with water after it is moved to and installed in its intended operation location. The possibility exists that the water heater can be "dry fired"—i.e., have its electric resistance type heating element (s) energized before the storage tank portion of the heater is filled with water to immerse the heating element(s) projecting into its interior. When such dry firing occurs, each dry fired electric heating element typically burns out, resulting in a return of the unit to the manufacturer, or a service call by a repair technician to perform an on-site element replacement. The cost of either repair procedure can be quite substantial.

Various solutions have previously been proposed to prevent the firing of heating elements in electric water heaters unless the elements are immersed in water introduced into the storage tank portion of the water heater. Primarily, these proposed solutions have taken two forms—float switch-based protective systems, and temperature sensor-based protective systems.

In the float switch system, a buoyant float member is movably supported within the tank and mechanically linked to a normally open electrical switch which, until closed, precludes current flow through the heating element(s). When a quantity of water sufficient to cover all of the electric heating elements is introduced into the tank, the float member is lifted by the water to cause the lifted float to close its associated electrical switch and permit the now immersed heating element to be fired.

In the temperature sensing system, the temperature of the electrical resistance heating element(s) is monitored and, if a preset upper temperature limit (indicative of the dry firing of the element) is sensed, the current flow to the non-immersed element(s) is interrupted to prevent burning out of the element(s).

Neither of these previously proposed dry fire protection techniques has proven to be entirely satisfactory. For example, each tends to be fairly complex and undesirably expensive to incorporate into the overall water heater assembly. Additionally, these previously proposed systems have often proven to be unreliable, and tend to be undesirably invasive of the interior of the storage tank portion of the water heater (particularly in the case of the float switch-based protective system). Moreover, in the case of the float switch-based protective system since movable parts are in contact with the stored water the movable linkage portion of the system can easily become encrusted with scale and be "frozen" over time.

In view of the foregoing it can readily be seen that a need exists for improved apparatus for providing an electric water heater with dry fire protection—particularly during the initial installation of the heater when dry firing of the heating element(s) has proven most likely to occur. It is accordingly an object of the present invention to provide an electric water heater with such improved dry fire protection apparatus.

SUMMARY OF THE INVENTION

In carrying out principles of the present invention, in accordance with a preferred embodiment thereof, a liquid heating apparatus is provided which comprises a vessel for receiving a liquid, and an electric heating element extending into the interior of the vessel and operative to heat liquid disposed therein in response to a flow of electrical current through the heating element. Incorporated in the liquid heating apparatus is a unique dry fire protection system which prevents the electric heating element from being energized (i.e., "fired") prior to filling the tank up to a predetermined level therein with a liquid which immerses the heating element to thereby prevent firing damage thereto.

From a broad standpoint, the dry fire protection system comprises means for supporting a liquid-soluble member for exposure to liquid entering the vessel and for utilizing the supported liquid-soluble member to prevent current flow through the electric heating element until the liquid-soluble member is substantially dissolved by liquid entering the vessel.

In a preferred embodiment thereof, the liquid heating apparatus is an electric water heater, and the liquid-soluble member used to provide dry fire protection to the electric heating element is a water-soluble member, representatively an ordinary sugar cube. The water heater includes electrical circuitry through which electrical power may be operatively supplied to the electric heating element, and the dry fire protection system includes a switch structure openable to prevent current flow through the electrical circuitry and closable to permit current flow through the electrical circuitry. A switch closure member is biased toward a closed position in which it closes the switch structure, and is movable from its closed position to an open position in which it opens the switch structure. A support structure portion of the dry fire protection system supports the water-soluble member (1) for exposure to water introduced into the vessel and (2) in engagement with the switch closure member in a manner blocking movement thereof from its open position to its closed position until the water-soluble member is dissolved by water entering the vessel.

Preferably, the support structure includes a hollow housing disposed in the interior of the vessel, on the inner side of a screw-in plug sealingly inserted into a wall opening in the vessel, the heating element extending inwardly from the plug into the interior of the vessel. The housing is adapted to internally receive the water-soluble blocking member and has at least one wall opening through which water may enter the interior of the housing to dissolve the water-soluble blocking member therein. The switch closure member preferably has a portion slidingly and sealingly extending through the plug member and having an inner end positioned to be blocked by the liquid-soluble member and then enter the hollow housing when the blocking member dissolves.

In one multiple heating element version of the water heater, the dry fire protection system switch structure is interposed in electrical circuitry used to power the elements and directly protects a first heating element, with which the water-soluble blocking member is associated, from dry firing damage. Each additional electric heating element is indirectly protected from dry firing damage by a current sensing relay interposed in the electrical power circuitry and operative to sense electrical current flow through the first electric heating element and permit electrical current flow from the electrical power circuitry through the additional heating element(s) only during a sensed electrical current flow through the first electric heating element.

In a second multiple element version of the hot water heater electrical power circuitry is provided through which electrical power may be operatively supplied to each heating element via closable switch structures interposed in the electrical power circuitry—each such closable switch structure being associated with a different one of the heating elements. Electrical control circuitry is also provided and has connected therein coil structures each operable to close a different one of the closable switch structures using electrical current flowing through the control circuitry.

A protective switch structure is interposed in the electrical control circuitry adjacent a first one of the heating elements with which the water-soluble blocking member is associated, with the protective switch structure being openable to prevent electrical current flow through the electrical control circuitry, and closable to permit electrical current flow through the electrical control circuitry. The switch closure member portion of the dry fire protection system is biased toward a closed position in which it closes the protective switch structure, and is movable from this closed position to an open position in which it open the protective switch structure. Accordingly, until the blocking member is dissolved none of the power circuitry switch structures can be closed by their associated control circuitry coil structures to provide electrical power to their associated electric heating elements.

In a third embodiment of the water heater first and second electric heating elements respectively extend into upper and lower interior zones of the vessel and are operative to heat liquid disposed therein in response to a flow of electrical current through the heating elements. Electrical circuitry is coupled to the first and second heating elements, and first and second thermostats are interposed in the electrical circuitry.

The first and second thermostats are respectively operative to control the temperature of liquid in the upper and lower interior vessel zones by respectively enabling current flow through the first and second electric heating elements via the electrical circuitry in response to sensed demands for heat in the upper and lower interior vessel zones. The first thermostat is further operative to preclude current flow to the second electric heating element, via the second thermostat, until the first thermostat is satisfied.

A dry fire protection system is provided which is operative to prevent electrical current flow through the first and second electric heating elements until the vessel is filled to a predetermined level with water. The dry fire protection system includes a switch structure interposed in the electrical circuitry, the switch structure being openable to prevent electrical current flow from said electrical circuitry through the first electric heating element, and closable to permit electrical current flow through the first electric heating element. A switch closure member is biased toward a closed position in which it closes the switch structure, and is movable from the closed position to an open position in which it opens the switch structure. The dry fire protection system also includes a support structure for supporting a water-soluble blocking member adjacent the first electric heating element (1) for exposure to water introduced into the vessel, and (2) in engagement with the switch closure member in a manner blocking movement thereof from its open position to its closed position until the blocking member is dissolved by water entering the vessel.

DETAILED DESCRIPTION

Figure 1:
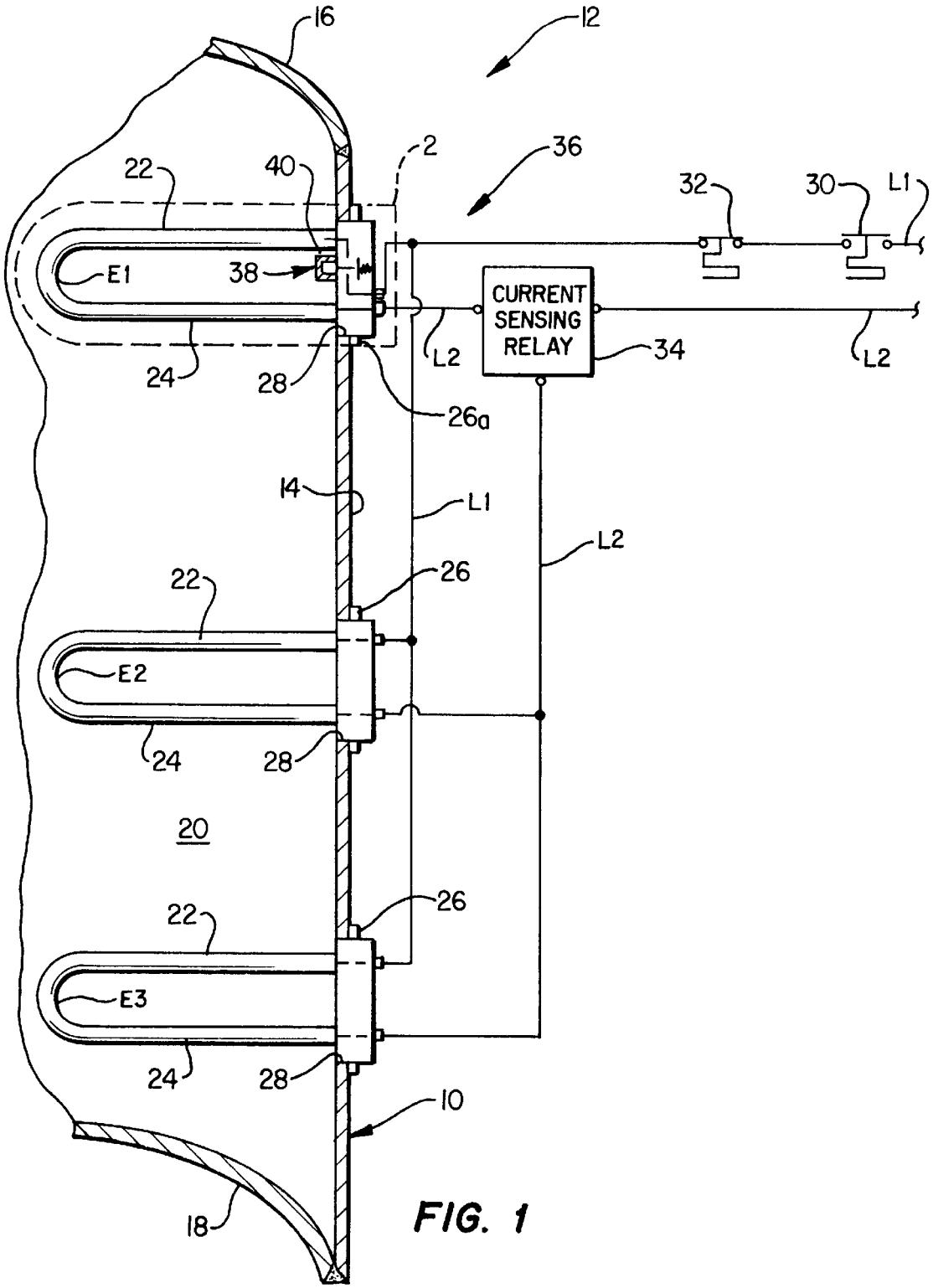
FIG. 1 is a schematic diagram of a portion of a representative electric water heater having incorporated therein a specially designed dry fire protection system embodying principles of the present invention.

Cross-sectionally illustrated in simplified form in FIG. 1 is a portion of the metal storage tank 10 of a representative electric water heater 12. Illustratively, the tank 10 has a vertically elongated cylindrical configuration with an annular side wall section 14, a domed top head portion 16, a domed bottom head portion 18, and an interior space 20. Tank 10 is suitably disposed within a conventional outer insulating jacket structure (not shown), is provided with conventional water inlet, outlet and drain fittings (also not shown), and is operative to store heated water therein for subsequent on-demand delivery of heated water from the tank.

Figure 2:
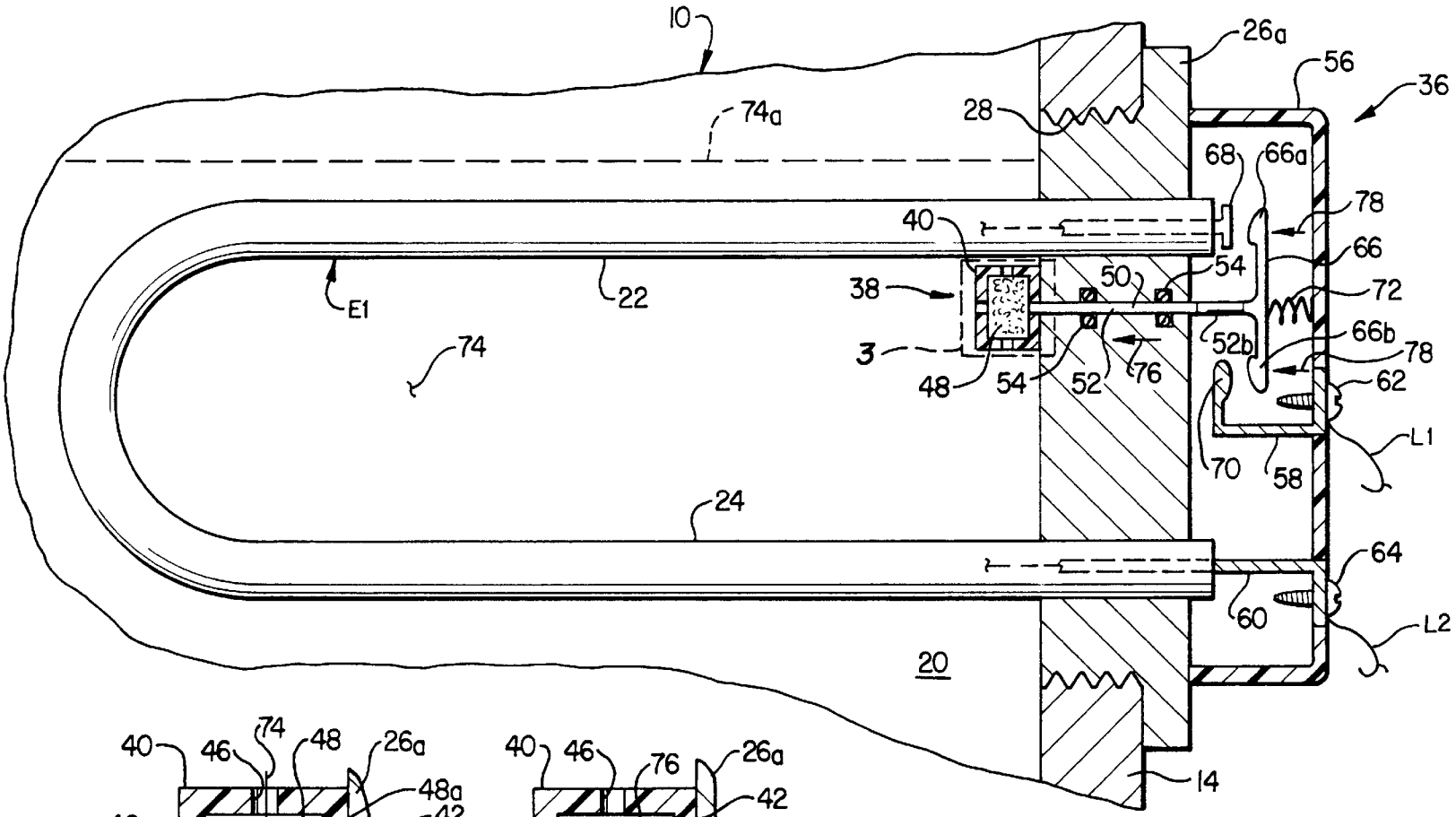
FIG. 2 is an enlarged scale cross-sectional detail view of the dashed line area "2" in FIG. 1.

To heat the water within the interior 20 of the tank 10, one or more generally U-shaped insertion type electric resistance heating elements are used. Representatively, the water heater 12 is provided with three vertically spaced resistance heating elements of this type—an upper element E1, a vertically intermediate element E2 and a bottom element E3. As also shown in FIG. 2, each heating element has opposite parallel leg portions 22,24 whose outer or free ends are mounted on a screw-in plug 26 threaded into a corresponding hole 28 in the tank side wall 14 so that the curved, closed end of the heating element projects horizontally into the interior 20 of the tank 10. When installed in its associated hole 28, each plug 26 forms a portion of the overall side wall structure of the tank 10.

Electrical power is operatively supplied to the outer ends of the three heating elements E1,E2 and E3 via line voltage leads L1 and L2 (see FIG. 1). A conventional thermostat 30 and a conventional normally closed ECO high limit switch 32 are installed as shown in lead L1. The thermostat 30 is operative to sense the water temperature within tank 10 and responsively control the operation of the heating elements E1,E2 and E3. A suitable current sensing relay 34 (such as a Hall effect sensor) is installed as shown in the L2 side of the line voltage circuitry. The sensing relay 34 is operative to prevent the supply of electrical power, via leads L1 and L2 to the middle and lower heating elements E2 and E3 unless it senses a current flow through the uppermost heating element E1.

The current sensing relay 34 forms a part of a unique dry fire protection system 36 associated with the water heater 12 and embodying principles of the present invention. With reference now to FIGS. 1–3B, the system 36 also includes a water level sensing structure 38 comprising a small rectangularly cross-sectioned housing 40 disposed generally between the legs 22,24 of the uppermost heating element E1 and having a side wall 42 suitably secured to the inner side surface of the uppermost screw-in plug 26*a*. The housing 40 has an opening 44 in its wall 42 (see FIGS. 3A and 3B), and a spaced plurality of water inlet openings 46 extending inwardly through its other walls into its interior. Prior to the initial filling of the tank 10 with water, a water-dissolvable blocking member 48, representatively an ordinary sugar cube, is complementarily received in the interior of the housing 40 with a side 48*a* of the cube 48 positioned against the inner side surface of the housing wall 42.

The housing wall opening 44 is aligned with the inner end of a horizontal opening 50 that extends through the uppermost plug member 26*a* and slidably and sealingly receives a cylindrical metal rod 52 having an inner end 52*a* and an outer end portion 52*b* formed from a suitable dielectric material (see FIG. 2). The sealing mechanism within the opening 50 representatively comprises a spaced pair of elastomeric O-ring seal members 54.

As best illustrated in FIG. 2, a small plastic housing 56 is suitably secured to the outer side of the uppermost plug member 26*a*. First and second metal contact structures 58,60 extend inwardly into the interior of the housing 56 and are respectively connected, via screws 62 and 64, to the electrical power leads L1 and L2. Secured to the dielectric outer end portion 52*b* of the metal rod 52 is a laterally enlarged transverse metal contactor section or switch closure member 66 disposed within the housing 56 and having opposite outer side portions 66*a*,66*b* that respectively overlie a metal contactor portion 68 on the outer end of the leg 22 on the upper element E1 and a transverse inner end portion 70 of the contact structure 58. As illustrated in FIG. 2, the other contact structure 60 is electrically coupled to the outer end of the leg 24 of the upper element E1.

Prior to the installation of the water heater 12, and the initial filling of its tank 10 with water to be heated by the resistance type electrical heating elements E1,E2 and E3, the inner end 52*a* of the rod 52 (see FIGS. 2 and 3A) bears against the side 48*a* of the sugar cube 48 within the housing 40, and the rod 52 is in its FIG. 2 position in which the rod 52 is resiliently biased in a leftward direction (i.e., axially toward the interior 20 of the tank 10) by a compressed coil spring member 72 bearing at its opposite ends on the outer side of the contactor section 66 and a facing interior side surface portion of the housing 56.

With the rod 52 in this position the opposite side portions 66*a*,66*b* of the contactor section 66 on rod 52 are held by the sugar cube 48 in outwardly spaced relationships with their facing contactor portions 68 and 70 as shown in FIG. 2, thereby preventing electrical current flow through the heating element E1 between the portions of the power leads L1 and L2 connected to the contact structures 58 and 60, In turn, since electrical current cannot flow through the uppermost heating element E1, there can be no current flow via lead L2 horizontally across the current sensing relay 34 as viewed in FIG. 1. Due to the absence of current flow through the relay 34 it thus prevents the supply of electrical power to the middle and lower heating elements E2 and E3. The open power supply subcircuit portion at element E1 which protects element E1 from being dry fired and damaged also functions to protect the other two elements E2 and E3 from being dry fired and damaged. Thus, even if the water heater 12 is wired up and turned on, and the thermostat 30 calls for heat, prior to the tank 10 being filled with water, none of the heating elements can be fired.

Figure 3B:
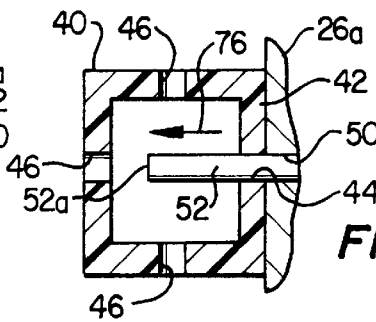
FIGS. 3A and 3B are enlarged scale simplified cross-sectional detail views of the dashed line area "3" in FIG. 2 and sequentially illustrate the operation of a dissolvable blocking element portion of the dry fire protection system.
Figure 3A:
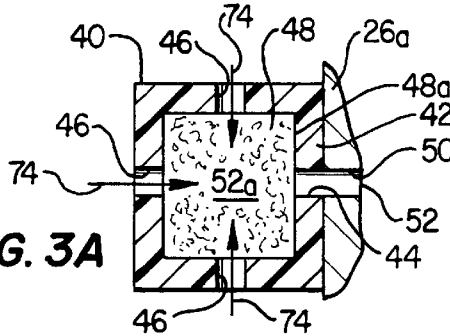

However, when water 74 is introduced into the interior 20 of the tank 10, at least to the representative dashed line level 74a upwardly adjacent the internal housing 40 (see FIG. 2), water 74 (see FIG. 3A) enters the interior of the housing 40 and dissolves the sugar cube 48 therein as shown in FIG. 3B. The dissolving of the sugar cube 48 permits the spring 72 (see FIG. 2) to leftwardly push the rod 52 through the plug opening 50, as indicated by the arrows 76 in FIGS. 2 and 3B, thereby pushing an inner end portion of the rod 52 into the housing through its wall opening 44, and leftwardly driving the contactor section 66, as indicated by the arrows 78 in FIG. 2, to move the outer contactor sections 66*a*,66*b* into engagement with their facing contactor portions 68 and 70.

This spring-driven engagement of the contactor portions 66*a*,66*b* with their facing contactor portions 68,70 closes the power supply circuit portion at the upper heating element E1 and allows electrical current to flow through the element between the portions of the power supply leads L1 and L2 connected to the screws 62,64 shown in FIG. 2. Current flow through element E1 causes a corresponding current flow, via lead L2, leftwardly through the current sensing relay 34 as viewed in FIG. 1, thereby permitting electrical current flow through the other two heating elements E2 and E3 as previously described.

In summary, the single sugar cube 48 (or other blocking member formed from a suitable alternative water-dissolvable material) protects all of the heating elements E1, E2 and E3 from being dry fired and damaged prior to the initial filling of the tank 10 with water. This unique dry fire protective function is advantageously achieved with only a minimal physical invasion of the protective system (i.e., the small internal housing 40 and the sugar cube 48) into the interior 20 of the tank 10. Additionally, the protective system 36 does not require any moving parts within the tank 10, and does not rely on the sometimes inaccurate sensing of the temperature of the inserted heating elements to prevent dry fire damage thereto. While a water-soluble blocking member other than the representatively illustrated sugar cube 48 can be used, in the depicted water heater application the sugar cube 48 has the advantages that it is extremely inexpensive, readily available, strong and, when dissolved, does not in any way harm or contaminate the water within the tank.

As can readily be appreciated, the system 36 is relatively inexpensive to construct and is quite simple to install. In this latter regard it should be noted that the screw-in heating element subassembly shown in FIG. 2 (i.e., the element E1, inner housing 40, sugar cube 48, plug 26*a*, outer housing 56 and its associated spring-driven contactor structure) may be assembled in its entirety and simply threaded onto the tank 10 in a ready-to-wire condition. Additionally, while the protective system 36 is primarily intended to provide a "one time" protective function at the initial filling of the tank 10, the element subassembly can easily be removed at a later date and reset with the simple placement of a new sugar cube or other water-soluble blocking element.

Figure 4:
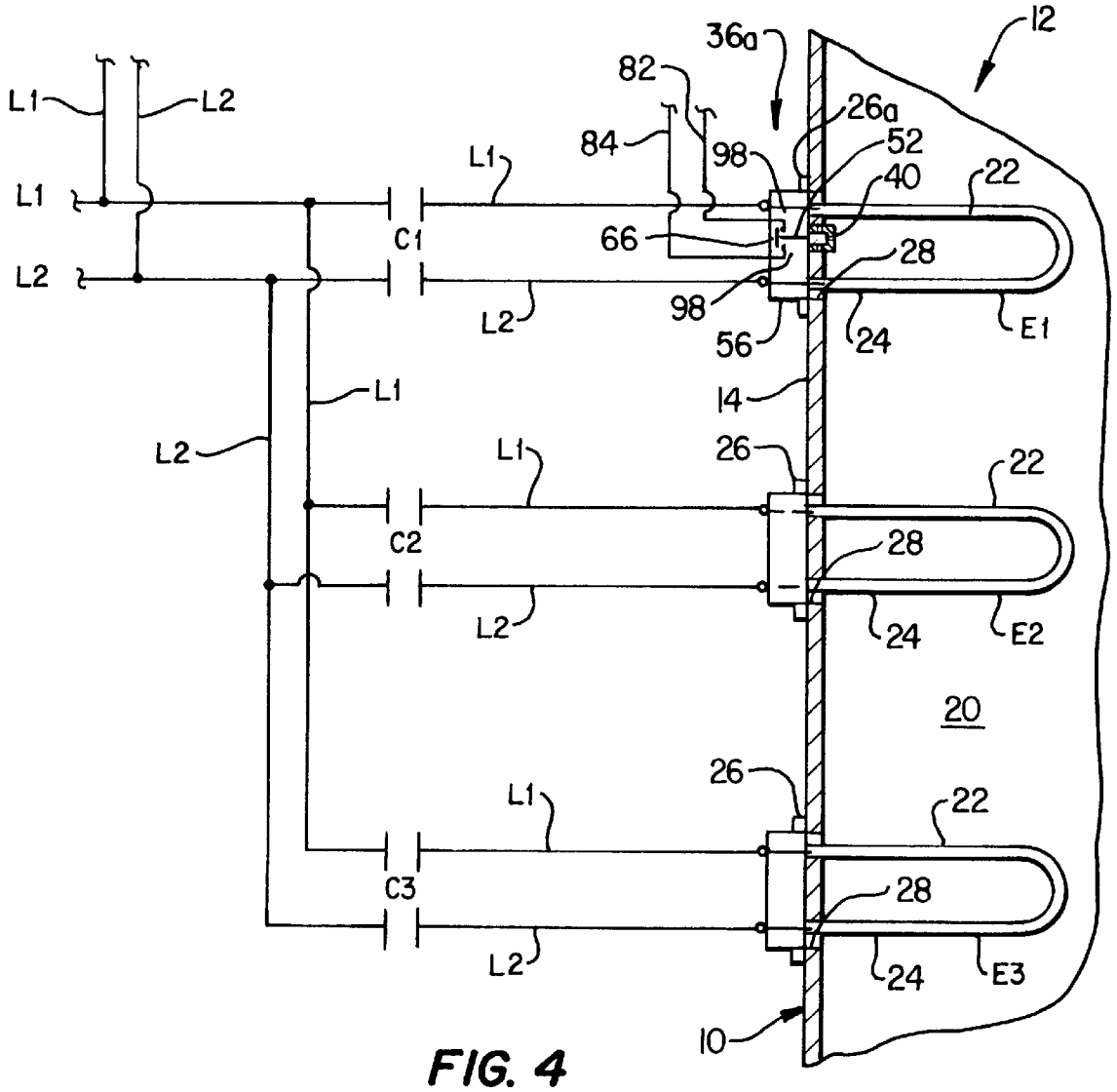
FIG. 4 is a schematic diagram of a representative electric water heater having incorporated therein a first alternate embodiment of the dry fire protection system.

As described above, the dry fire protection system 36 functions to directly protect the uppermost heating element E1 and, via the current sensing relay 34, indirectly protect the other two heating elements E2 and E3. Illustrated in FIG. 4 is a portion of an alternate embodiment 36*a* of the previously described dry fire protection system 36. In contrast to the system 36 the system 36*a* indirectly protects the representatively illustrated three heating elements E1, E2 and E3 and is not incorporated in the line voltage power supply circuit formed by the illustrated leads L1 and L2, but instead is incorporated in a low voltage control circuit portion 80 (see FIG. 5) of the dry fire protection system 36*a*.

Figure 5:
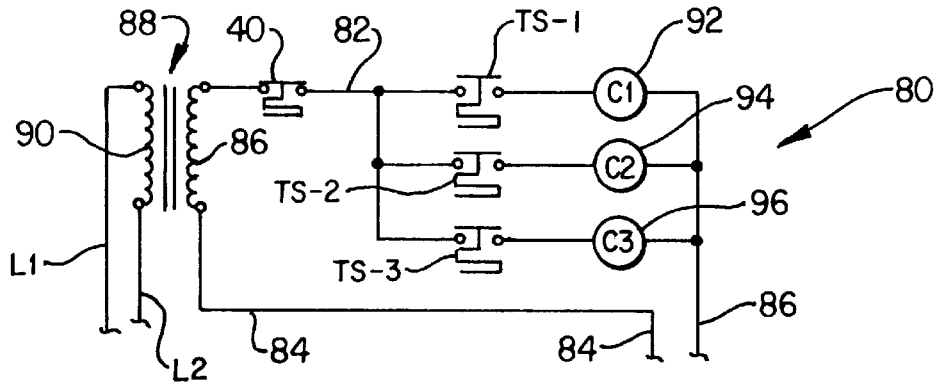
FIG. 5 is a schematic diagram of a low voltage control wiring portion of the FIG. 4 dry fire protection system.

Low voltage control circuit 80 includes electrical control leads 82 and 84 which are connected as shown to the low winding side 86 of a control transformer 88 having a high winding side 90 to which the line voltage power leads L1 and L2 are operatively connected. An ECO switch 90 is operatively connected in lead 82 as illustrated in FIG. 5. Connected in parallel in lead 82 are (1) a thermostat TS-1 and a coil 92 in series therewith, (2) a thermostat TS-2 and a coil 94 in series therewith, and (3) a thermostat TS-3 and a coil 96 in series therewith. Leads 82,84 (see FIG. 4) are connected to the terminals of a low voltage switch 98 disposed in the outer housing 56 of the uppermost heating element E1. With the sugar cube or other water-soluble blocking member positioned in the interior housing 40, and prior to filling the tank 10 with water, the outer contactor end portion 66 of the previously described spring-loaded rod 52 is maintained in an outwardly spaced relationship with the terminals of the switch 98, thereby maintaining the switch 98 in an open state and preventing current flow through the control circuit 80.

Thermostats TS-1, TS-2 and TS-3 are respectively associated in a sequencing manner with the heating elements E1, E2 and E3 by the coils 92,94,96 which, in response to current flow therethrough, respectively close normally open contactor switches C1,C2 and C3 (see FIG. 4) in the three indicated L1/L2 power lead sets connected to the heating elements E1, E2 and E3. Prior to the initial filling of the tank 10 with water, the open low voltage switch 98 prevents current flow through the coils 92,94 and 96, thereby maintaining the contactor switches C1,C2 and C3 in their normally open states and preventing current flow through the heating elements E1, E2 and E3.

When the tank 10 is initially filled with water, at least to a level at or above that of the interior housing 40, the sugar cube within the housing 40 dissolves, thereby permitting the contactor section 66 to be spring-driven rightwardly as viewed in FIG. 4 to close the switch 98 and permit current flow through the low voltage control circuit 80. This, in turn, permits any of the thermostats TS-1, TS-2 and TS-3 to cause electrical current to pass through its associated coil 92,94 or 96 to thereby close its associated contactor switch C1, C2 or C3 to energize one or more of the now safely immersed resistance type electrical heating elements E1, E2 and E3.

Figure 6:
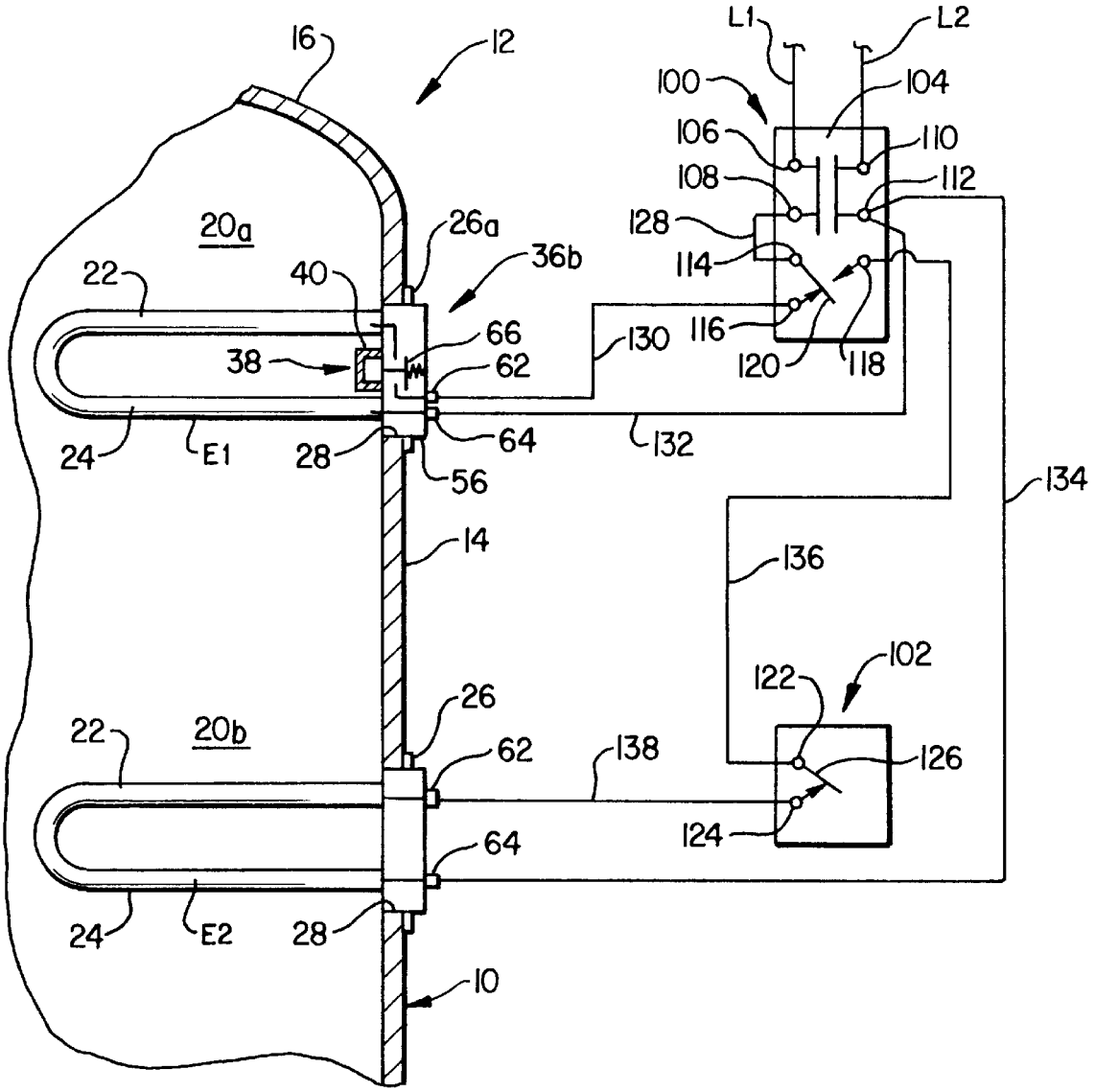
FIG. 6 is a schematic diagram of a representative electric water heater having incorporated therein a second alternate embodiment of the dry fire protection system.

A second alternate embodiment 36*b* of the previously described dry fire protection system 36 is schematically depicted in FIG. 6 and is used in conjunction with an electric water heater 12 which is of the double element, non-simultaneous operation type typically used in residential applications. The water heater 12 shown in FIG. 6 has an upper electric resistance type heating element E1 which serves an upper interior portion 20*a* of the tank 10, and a lower electric resistance type heating element E2 which serves a lower interior portion 20*b* of the tank 10.

The upper and lower heating elements E1 and E2 in the water heater 12 shown in FIG. 6 are respectively controlled by thermostats 100 and 102, with thermostat 100 being operative to sense the water temperature in the upper interior tank zone 20*a* and thermostat 102 being operative to sense the water temperature in the lower interior tank zone 20*b*. The structure of the dry fire protection system 36*b* is essentially identical to that of the previously described system 36 shown in FIG. 2, but the system 36*b* is utilized in conjunction with the two thermostats 100,102 to directly protect the upper heating element E1, and indirectly protect the lower heating element E2, in a somewhat different manner which will now be described.

The upper thermostat 100 has an ECO switch 104 operatively coupled between terminal pairs 106,108 and 110,112, with main electrical power leads L1 and L2 being respectively connected to the terminals 106 and 110, and terminals 114,116 and 118. A movable contact arm 120 is pivotally connected to terminal 114 and contacts terminal 116 when the thermostat 100 is calling for heat, and contacts terminal 118 when the thermostat 100 is satisfied.

The lower thermostat 102 has terminals 122 and 124. A movable contact arm 126 is pivotally connected to the terminal 122 and contacts terminal 124 when the thermostat 102 is calling for heat, and is swung away from the terminal 124 when the thermostat 102 is satisfied.

On the upper thermostat 100 terminals 108 and 114 are connected by a lead 128, terminal 116 is connected to terminal 62 of the upper heating element E1 by a lead 130, terminal 112 is connected to terminal 64 of the upper heating element E1 by a lead 132, terminal 112 is connected to the terminal 64 of the lower heating element E2 by a lead 134, and terminal 118 of the upper thermostat 100 is connected to the terminal 122 of the lower thermostat 102 by a lead 136. Terminal 124 of the lower thermostat 102 is connected to the terminal 62 of the lower heating element E2 by a lead 138.

Still referring to FIG. 6, prior to filling the tank 10 with water, both of the thermostats 100 and 102 are calling for heat, with the movable contact arm 120 of the upper thermostat 100 engaging the upper thermostat terminal 116, and the movable contact arm 126 of the lower thermostat engaging the lower thermostat terminal 124. As can be seen, with the movable thermostat contact arms 120,126 in these positions, electrical current from the power leads L1,L2 cannot flow through the lower heating element E2 with the contact arm 120 swung away from the upper thermostat terminal 118, and electrical current from the power leads L1,L2 cannot flow through the upper heating element E1 until, as previously described in conjunction with the dry fire protection system 36 shown in FIG. 2, the housing 40 portion of the dry fire protection system 36b is immersed with water to permit its contactor section 66 to be spring-driven to its closed position.

When the tank 10 is initially filled with water, and the housing 40 portion of the system 36*b* is immersed, the closure of the contactor section 66 permits L1/L2 current flow through the upper heating element E1 via the upper thermostat 100 and its output leads 130 and 132. While the upper thermostat 100 is being satisfied, however, current flow to the lower heating element E2 is still precluded by the upper thermostat 100 while its movable contact arm 120 is swung away from its terminal 118.

After the upper thermostat 100 is satisfied, and its contact arm 120 swings away from terminal 116 and contacts the terminal 118, L1/L2 current flow through the upper heating element E1 is terminated and L1/L2 current flow through the lower heating element E2 is initiated via the leads 136,138 and 134. When the lower thermostat 102 is then satisfied, its contact arm 126 swings away from the terminal 124 to terminate current flow through the lower heating element E2.

As previously mentioned, the double element, non-simultaneous operation electric water heater 12 schematically depicted in FIG. 6 utilizes the dry fire protection system 36*b* to directly protect the upper heating element E1, while indirectly protecting the lower heating element E2. Thus, one dry fire protection system is used to protect both electric resistance type heating elements. The water heater 10 shown in FIG. 6 could alternatively be wired, in a known manner, to permit the heating elements E1 and E2 to operate simultaneously under the control of their respective thermostats 100 and 102. In this case the lower heating element E2 would also be provided with a dry fire protection system 36*b* like that of the upper element E1 to thereby directly protect each of the heating elements E1 and E2 against dry fire damage.

While the dry fire protection systems 36, 36*a* and 36*b* have been representatively illustrated as being incorporated in an electric water heater, it will be readily appreciated by those of skill in this particular art that they could also be utilized to advantage in a variety of other types of vessels adapted to receive a liquid to be heated by one or more electric heating elements operatively disposed within the vessel. For example, electric heating element dry fire protection principles of the present invention could be incorporated into various types of electric element-based process heaters such as those used for lubricating and hydraulic liquids, solvents, and a wide variety of other process liquids.

The foregoing detailed description is to be clearly understood as being given by way of illustration and example only, the spirit and scope of the present invention being limited solely by the appended claims.

What is claimed is:

1. Apparatus for heating a liquid, comprising:

a vessel for receiving a liquid;

an electric heating element extending into the interior of said vessel and operative to heat liquid disposed therein in response to a flow of electrical current through said electric heating element; and means for supporting a liquid-soluble member for exposure to liquid entering said vessel and for utilizing the supported liquid-soluble member to prevent current flow through said electric heating element until said liquid-soluble member is substantially dissolved by liquid entering said vessel, said means for suniorting and utilizing including:

a hollow housing supported on said vessel and adapted to receive said licuid-soluble blocking member, said hollow housing having an opening through which liquid within said vessel may enter the interior of said hollow housing and dissolve the received liquid-soluble blocking member, and a switch structure through which electrical current from a source thereof may be flowed to said electric heating element, said switch structure having a closure member biased toward a closed position and blockable in an open position by the received liquid-soluble blocking member in an undissolved state.

2. The apparatus of claim 1 further comprising a liquid-soluble member supported within said hollow housing and blocking movement of said closure member toward its closed position.

3. The apparatus of claim 2 wherein:

said apparatus is an electric water heater, and said liquid-soluble member is a water-soluble member.

4. The apparatus of claim 3 wherein said water-soluble member is a sugar cube.

5. Apparatus for heating a liquid, comprising:

a vessel for receiving a liquid;

an electric heating element extending into the interior of said vessel and operative to heat liquid disposed therein in response to a flow of electrical current through said electrical heating element;

electrical circuitry through which electrical power may be operatively supplied to said electric heating element; and a dry fire protection system operative to prevent electrical current flow through said electric heating element until said vessel is filled to a predetermined level with a liquid, said dry fire protection system including:

a switch structure openable to prevent current flow through said electrical circuitry and closable to permit current flow through said electrical circuitry, a switch closure member biased toward a closed position in which it closes said switch structure, and movable from said closed position to an open position in which it opens said switch structure; and a support structure for supporting a liquid-soluble blocking member for exposure to liquid introduced into said vessel and in engagement with said switch closure member in a manner blocking movement thereof from said open position to said closed position until said liquid-soluble blocking member is dissolved by liquid entering said vessel, said support structure including a hollow housing supported on said vessel and adapted to receive the liquid-soluble blocking member, said hollow housing having an opening therein through which liquid within said vessel may enter the interior of said hollow housing.

6. The apparatus of claim 5 wherein:

said apparatus is a water heater, and said vessel is a water storage tank.

7. Apparatus for heating a liquid, comprising:

a vessel for receiving a liquid;

an electric heating element extending into the interior of said vessel and operative to heat liquid disposed therein in response to a flow of electrical current through said electrical heating element;

electrical circuitry through which electrical power may be operatively supplied to said electric heating element; and a dry fire protection system operative to prevent electrical current flow through said electric heating element until said vessel is filled to a predetermined level with a liquid, said dry fire protection system including:

a switch structure openable to prevent current flow through said electrical circuitry and closable to permit current flow through said electrical circuitry, a switch closure member biased toward a closed position in which it closes said switch structure, and movable from said closed position to an open position in which it opens said switch structure; and a support structure for supporting a liquid-soluble blocking member for exposure to liquid introduced into said vessel and in engagement with said switch closure member in a manner blocking movement thereof from said open position to said closed position until said liquid-soluble blocking member is dissolved by liquid entering said vessel, said support structure including a hollow housing disposed in the interior of said vessel and adapted to internally receive the liquid-soluble blocking member, said hollow housing having at least one wall opening therein through which liquid may enter the interior of said hollow housing.

8. The apparatus of claim 7 wherein said switch closure member has a portion slidingly and sealingly extending through an outer wall section of said vessel and having an inner end positioned to be blocked by the liquid-soluble blocking member and then enter said hollow housing when the liquid-soluble blocking member dissolves.

9. The apparatus of claim 8 further comprising a liquid-soluble blocking member received in said hollow housing.

10. The apparatus of claim 9 wherein:

said vessel is adapted to receive water, and said liquid-soluble blocking member is a water-soluble blocking member.

11. The apparatus of claim 10 wherein said water-soluble blocking member is a sugar cube.

12. An electric heating assembly insertable inwardly through a wall opening in a vessel adapted to receive a liquid to be heated, said electric heating assembly comprising:

a plug structure sealingly insertable in the vessel wall opening and having inner and outer sides;

an electric heating element projecting outwardly from said inner side of said plug structure and positionable within the interior of the vessel when said plug structure is sealingly received in the vessel wall opening;

an electrical circuit structure, carried on said outer side of said plug structure, through which electrical power from an external source may be operatively transmitted to said electrical heating element;

a switch structure associated with said circuit structure and being openable to prevent current flow through said electric heating element, and closable to permit current flow through said electric heating element;

a switch closure member biased toward a closed position in which it closes said switch structure, and movable from said closed position to an open position in which it opens said switch structure; and a support structure, carried by said plug structure, for supporting a liquid-soluble blocking member for exposure to liquid introduced into said vessel and in engagement with said switch closure member in a manner blocking movement thereof from said open position to said closed position until said liquid-soluble blocking member is dissolved by liquid entering said vessel, said support structure including a hollow housing carried by said plug structure and adapted to internally receive the liquid-soluble blocking member, said hollow housing having at least one wall opening therein through with liquid from within the vessel may enter the interior of said hollow housing when said plug structure is operatively installed on the vessel.

13. The electric heating assembly of claim 12 wherein said switch closure member has a portion slidingly and sealingly extending through said plug structure and having an inner end positioned to be blocked by the liquid-soluble blocking member and then enter said hollow housing when the liquid-soluble blocking member dissolves.

14. The electric heating assembly of claim 13 further comprising a liquid-soluble blocking member received in said hollow housing.

15. The electric heating assembly of claim 14 wherein said liquid-soluble blocking member is a water-soluble blocking member.

16. The electric heating assembly of claim 15 wherein said water-soluble blocking member is a sugar cube.

17. Apparatus for heating a liquid, comprising:

a vessel for receiving a liquid;

a first electric heating element extending into the interior of said vessel and operative to heat liquid disposed therein in response to a flow of electrical current through said first electric heating element;

a second electric heating element extending into the interior of said vessel and operative to heat liquid therein in response to a flow of electrical current through said second electric heating element;

electrical circuitry through which electrical power may be operatively supplied to said first and second electric heating elements; and a dry fire protection system operative to prevent electrical current flow through said first and second electric heating elements until said vessel is filled to a predetermined level with a liquid, said dry fire protection system including:

a switch structure interposed in said electrical circuitry, said switch structure being openable to prevent electrical current flow from said electrical circuitry through said first electric heating element, and closable to permit electrical current flow through said first electric heating element, a switch closure member biased toward a closed position in which it closes said switch structure, and movable from said closed position to an open position in which it opens said switch structure, a support structure for supporting a liquid-soluble blocking member adjacent said first electric heating element for exposure to liquid introduced into said vessel and in engagement with said switch closure member in a manner blocking movement thereof from said open position to said closed position until said liquid-soluble blocking member is dissolved by liquid entering said vessel, said support structure including a hollow housing supported on said vessel adjacent said first electric heating element and adapted to internally receive the liquid-soluble blocking members said hollow housing having at least one wall opening therein through which liquid may enter the interior of said hollow housing, and means for sensing electrical current flow through said first electric heating element and permitting electrical current flow from said electrical circuitry through said second electric heating element only during a sensed electrical current flow through said first electric heating element.

18. The apparatus of claim 17 wherein:

said apparatus is a water heater, and said vessel is a water storage tank.

19. Apparatus for heating a liquid, comprising:

a vessel for receiving a liquid;

a first electric heating element extending into the interior of said vessel and operative to heat liquid disposed therein in response to a flow of electrical current through said first electric heating element;

a second electric heating element extending into the interior of said vessel and operative to heat liquid therein in response to a flow of electrical current through said second electric heating element;

electrical circuitry through which electrical power may be operatively supplied to said first and second electric heating elements; and a dry fire protection system operative to prevent electrical current flow through said first and second electric heating elements until said vessel is filled to a predetermined level with a liquid, said dry fire protection system including:

a switch structure interposed in said electrical circuitry, said switch structure being openable to prevent electrical current flow from said electrical circuitry through said first electric heating element, and closable to permit electrical current flow through said first electric heating element, a switch closure member biased toward a closed position in which it closes said switch structure, and movable from said closed position to an open position in which it opens said switch structure, a support structure for supporting a liquid-soluble blocking member adjacent said first electric heating element for exposure to liquid introduced into said vessel and in engagement with said switch closure member in a manner blocking movement thereof from said open position to said closed position until said liquid-soluble blocking member is dissolved by liquid entering said vessel, and means for sensing electrical current flow through said first electric heating element and permitting electrical current flow from said electrical circuitry through said second electric heating element only during a sensed electrical current flow through said first electric heating element, said support structure including a hollow housing disposed in the interior of said vessel adjacent said first electric heating element and adapted to internally receive the liquid-soluble blocking member, said hollow housing having at least one wall opening therein through which liquid may enter the interior of said hollow housing.

20. The apparatus of claim 19 wherein said switch closure member has a portion slidingly and sealingly extending through an outer wall section of said vessel and having an inner end positioned to be blocked by the liquid-soluble blocking member and then enter said hollow housing when the liquid-soluble blocking member dissolves.

21. The apparatus of claim 20 further comprising a liquid-soluble blocking member received in said hollow housing.

22. The apparatus of claim 21 wherein:

said vessel is adapted to receive water, and said liquid-soluble blocking member is a water-soluble blocking member.

23. The apparatus of claim 22 wherein said water-soluble blocking member is a sugar cube.

24. The apparatus of claim 17 wherein said means for sensing current flow include a current sensing relay operably interposed in said electrical circuitry.

25. Apparatus for heating a liquid, comprising:

a vessel for receiving a liquid;

a first electric heating element extending into the interior of said vessel and operative to heat liquid disposed therein in response to a flow of electrical current through said first electric heating element;

a second electric heating element extending into the interior of said vessel and operative to heat liquid therein in response to a flow of electrical current through said second electric heating element;

electrical power circuitry through which electrical power may be operatively supplied to said first and second electric heating elements respectively via first and second closable switch structures interposed in said electrical power circuitry;

electrical control circuitry having connected therein first and second coil structures respectively operable to close said first and second closable switch structures using electrical current flowing through said control circuitry; and a dry fire protection system operative to prevent electrical current flow through said first and second electric heating elements until said vessel is filled to a predetermined level with a liquid, said dry fire protection system including:

a protective switch structure interposed in said electrical control circuitry, said protective switch structure being openable to prevent electrical current flow through said electrical control circuitry, and closable to permit electrical current flow through said electrical control circuitry, a switch closure member biased toward a closed position in which it closes said protective switch structure, and movable from said closed position to an open position in which it opens said protective switch structure, and a support structure for supporting a liquid-soluble blocking member adjacent said first electric heating element for exposure to liquid introduced into said vessel and in engagement with said switch closure member in a manner blocking movement thereof from said open position to said closed position until said liquid-soluble blocking member is dissolved by liquid entering said vessel, said support structure including a hollow housing carried on said housing and adapted to internally receive the liquid-soluble blocking member, said hollow housing having at least one wall opening therein through which liquid may enter the interior of said hollow housing.

26. The apparatus of claim 25 wherein:

said apparatus is a water heater, and said vessel is a water storage tank.

27. Apparatus for heating a liquid, comprising:

a vessel for receiving a liquid;

a first electric heating element extending into the interior of said vessel and operative to heat liquid disposed therein in response to a flow of electrical current through said first electric heating element;

a second electric heating element extending into the interior of said vessel and operative to heat liquid therein in response to a flow of electrical current through said second electric heating element;

electrical power circuitry through which electrical power may be operatively supplied to said first and second electric heating elements respectively via first and second closable switch structures interposed in said electrical power circuitry;

electrical control circuitry having connected therein first and second coil structures respectively operable to close said first and second closable switch structures using electrical current flowing through said control circuitry; and a dry fire protection system operative to prevent electrical current flow through said first and second electric heating elements until said vessel is filled to a predetermined level with a liquid, said dry fire protection system including:

a protective switch structure interposed in said electrical control circuitry, said protective switch structure being openable to prevent electrical current flow through said electrical control circuitry, and closable to permit electrical current flow through said electrical control circuitry, a switch closure member biased toward a closed position in which it closes said protective switch structure, and movable from said closed position to an one position in which it opens said protective switch structure, and a support structure for supporting a liquid-soluble blocking member adjacent said first electric heating element for exposure to liquid introduced into said vessel and in engagement with said switch closure member in a manner blocking movement thereof from said open position to said closed position until said liquid-soluble blocking member is dissolved by liquid entering said vessel, said support structure including a hollow housing disposed in the interior of said vessel and adapted to internally receive the liquid-soluble blocking member, said hollow housing having at least one wall opening therein through which liquid may enter the interior of said hollow housing.

28. The apparatus of claim 27 wherein said switch closure member has a portion slidingly and sealingly extending through an outer wall section of said vessel and having an inner end positioned to be blocked by the liquid-soluble blocking member and then enter said hollow housing when the liquid-soluble blocking member dissolves.

29. The apparatus of claim 28 further comprising a liquid-soluble blocking member received in said hollow housing.

30. The apparatus of claim 29 wherein:

said vessel is adapted to receive water, and said liquid-soluble blocking member is a water-soluble blocking member.

31. The apparatus of claim 30 wherein said water-soluble blocking member is a sugar cube.

32. Apparatus for heating a liquid, comprising:

a vessel for receiving a liquid in upper and lower interior zones thereof;

a first electric heating element extending into said upper interior zone and operative to heat liquid disposed therein in response to a flow of electrical current through said first electric heating element;

a second electric heating element extending into said lower interior zone and operative to heat liquid disposed therein in response to a flow of electrical current through said second electric heating element;

electrical circuitry coupled to said first and second heating elements;

first and second thermostats interposed in said electrical circuitry and being respectively operative to control the temperature of liquid in said upper and lower interior zones by respectively enabling current flow through said first and second electric heating elements via said electrical circuitry in response to sensed demands for heat in said upper and lower interior zones, said first thermostat being further operative to preclude current flow to said second electric heating element, via said second thermostat, until said first thermostat is satisfied; and a dry fire protection system operative to prevent electrical current flow through said first and second electric heating elements until said vessel is filled to a predetermined level with a liquid, said dry fire protection system including:

a switch structure interposed in said electrical circuitry, said switch structure being openable to prevent electrical current flow from said electrical circuitry through said first electric heating element, and closable to permit electrical current flow through said first electric heating element, a switch closure member biased toward a closed position in which it closes said switch structure, and movable from said closed position to an open position in which it opens said switch structure, a support structure for supporting a liquid-soluble blocking member adjacent said first electric heating element for exposure to liquid introduced into said vessel and in engagement with said switch closure member in a manner blocking movement thereof from said open position to said closed position until said liquid-soluble blocking member is dissolved by liquid entering said vessel, said support structure including a hollow housing supported on said vessel adjacent said first electric heating element and adapted to internally receive the liquid-soluble blocking member, said hollow housing having at least one wall opening therein through which liquid may enter the interior of said hollow housing, and means for sensing electrical current flow through said first electric heating element and permitting electrical current flow from said electrical circuitry through said second electric heating element only during a sensed electrical current flow through said first electric heating element.

33. The apparatus of claim 32 wherein:

said apparatus is a water heater, and said vessel is a water storage tank.

34. Apparatus for heating a liquid, comprising:

a vessel for receiving a liquid in upper and lower interior zones thereof;

a first electric heating element extending into said upper interior zone and operative to heat liquid disposed therein in response to a flow of electrical current through said first electric heating element;

a second electric heating element extending into said lower interior zone and operative to heat liquid disposed therein in response to a flow of electrical current through said second electric heating element;

electrical circuitry coupled to said first and second heating elements;

first and second thermostats interposed in said electrical circuitry and being respectively operative to control the temperature of liquid in said upper and lower interior zones by respectively enabling current flow through said first and second electric heating elements via said electrical circuitry in response to sensed demands for heat in said upper and lower interior zones, said first thermostat being further operative to preclude current flow to said second electric heating element, via said second thermostat, until said first thermostat is satisfied; and a dry fire protection system operative to prevent electrical current flow through said first and second electric heating elements until said vessel is filled to a predetermined level with a liquid, said dry fire protection system including:

a switch structure interposed in said electrical circuitry, said switch structure being openable to electrical current flow from said electrical circuitry through said first electric heating element, and closable to permit electrical current flow through said first electric heating element, a switch closure member biased toward a closed position in which it closes said switch structure, and movable from said closed position to an open position in which it opens said switch structure, a support structure for supporting a liquid-soluble blocking member adjacent said first electric heating element for exposure to liquid introduced into said vessel and in engagement with said switch closure member in a manner blocking movement thereof from said open position to said closed position until said liquid-soluble blocking member is dissolved by liquid entering said vessel, and means for sensing electrical current flow through said first electric heating element and permitting electrical current flow from said electrical circuitry through said second electric heating element only during a sensed electrical current flow through said first electric heating element, said support structure including a hollow housing disposed in the interior of said vessel adjacent said first electric heating element and adapted to internally receive the liquid-soluble blocking member, said hollow housing having at least one wall opening therein through which liquid may enter the interior of said hollow housing.

35. The apparatus of claim 34 wherein said switch closure member has a portion slidingly and sealingly extending through an outer wall section of said vessel and having an inner end positioned to be blocked by the liquid-soluble blocking member and then enter said hollow housing when the liquid-soluble blocking member dissolves.

36. The apparatus of 35 further comprising a liquid-soluble blocking member received in said hollow housing.

37. The apparatus of claim 36 wherein:

said vessel is adapted to receive water, and said liquid-soluble blocking member is a water-soluble blocking member.

38. The apparatus of claim 37 wherein said water-soluble blocking member is a sugar cube.

39. Apparatus for heating a liquid, comprising:

a vessel for receiving a liquid;

an electric heating element extending into the interior of said vessel and operative to heat liquid disposed therein in response to a flow of electrical current through said electric heating element; and dry fire protection apparatus for preventing current flow through said electric heating element until it is immersed with liquid being flowed into said vessel to fill said vessel, said dry fire protection apparatus including:

a switch structure having a closure member oriented in an open position and being movable therefrom to a closed position in which said switch structure permits electrical current flow therethrough to said electric heating element, a liquid-soluble member exposed to the interior of said vessel and preventing said closure member from moving to said closed position, said liquid-soluble member being dissolvable by liquid entering said vessel, and a force exerting structure operative to move said closure member to said closed position in response to said liquid-soluble member being dissolved.

40. The apparatus of claim 39 wherein:

said electric heating element is a first electric heating element, and said apparatus further comprises:

a second electric heating element extending into the interior of said vessel and operative to heat liquid therein in response to a flow of electrical current through said second electric heating element, electrical circuitry through which electrical power may be supplied to said first and second electric heating elements, said switch structure being interposed in said electrical circuitry, and a sensing system operative to sense electrical current flow through said first electrical heating element and permit electrical current flow from said electrical circuitry through said second electrical heating element only during a sensed electrical current flow through said first electric heating element.

41. Apparatus for heating a liquid, comprising:

a vessel for receiving a liquid;

an electric heating element extending into the interior of said vessel and operative to heat liquid disposed therein in response to a flow of electrical current through said electric heating element; and dry fire protection apparatus for use with a liquid-soluble member to prevent current flow through said electric heating element unless said electric heating element is immersed by liquid in said vessel, said dry fire protection apparatus including:

a support structure for operatively supporting the liquid-soluble member for exposure to liquid entering the interior of said vessel, and a switch structure through which electrical current from a source thereof may be flowed to said electric heating element, said switch structure having a closure portion biased toward a closed position and blockable in an open position by the supported liquid-soluble member in an undissolved state.

42. The apparatus of claim 41 further comprising a liquid-soluble member operatively supported by said support structure.

43. An electric heating assembly insertable inwardly through a wall opening in a vessel adapted to receive a liquid to be heated, said electric heating assembly comprising:

a plug structure sealingly insertable in the vessel wall opening and having inner and outer sides;

an electric heating element projecting outwardly from said inner side of said plug structure and positionable within the interior of the vessel when said plug structure is sealingly received in the vessel wall opening;

an electrical circuit structure, carried on said outer side of said plug structure, through which electrical power from an external source may be operatively transmitted to said electrical heating element;

a switch structure associated with said circuit structure and being openable to prevent current flow through said electric heating element, and closable to permit current flow through said electric heating element;

a switch closure member carried by said plug structure and being movable between a closed position in which it closes said switch structure, and an open position in which it opens said switch structure;

a support structure carried by said plug structure and being operative, when said plug structure is sealingly inserted in the vessel wall opening, to support a liquid-soluble member, in an undissolved state, in an exposed relationship with the interior of vessel and position the supported liquid-soluble member to maintain said switch closure member in said open position; and a force exerting structure operative to move said switch closure member to said closed position in response to the liquid soluble member being dissolved by liquid entering said vessel.

44. Apparatus for heating a liquid, comprising:

a vessel for receiving a liquid;

a first electric heating element extending into the interior of said vessel and operative to heat liquid disposed therein in response to a flow of electrical current through said first electric heating element;

a second electric heating element extending into the interior of said vessel and operative to heat liquid disposed therein in response to flow of electrical current through said second electric heating element;

electrical power circuitry through which electrical power may be operatively supplied to said first and second electric heating elements respectively via first and second closable switch structures interposed in said electrical power circuitry;

electrical control circuitry having connected therein first and second coil structures respectively operable to close said first and second closable switch structures using electrical current flowing through said control circuitry; and dry fire protection apparatus operative to prevent electrical current flow through said first and second electric heating elements until said vessel is filled to a predetermined level with a liquid, said dry fire protection apparatus including:

a protective switch structure interposed in said electrical control circuitry, said protective switch structure being openable to prevent electrical current flow through said electrical control circuitry, and closable to permit electrical current flow through said electrical control circuitry, a switch closure member movable between a closed position in which it closes said switch structure, and an open position in which it opens said switch structure;

a support structure operative to support a liquid-soluble member, in an undissolved state, in an exposed relationship with the interior of vessel and position the supported liquid-soluble member to maintain said switch closure member in said open position; and a force exerting structure operative to move said switch closure member to said closed position in response to the liquid soluble member being dissolved by liquid entering said vessel.

45. Apparatus for heating a liquid, comprising:

a vessel for receiving a liquid in upper and lower interior zones thereof;

a first electric heating element extending into said upper interior zone and operative to heat liquid disposed therein in response to a flow of electrical current through said first electric heating element;

a second electric heating element extending into said lower interior zone and operative to heat liquid disposed therein in response to a flow of electrical current through said second electric heating element;

electrical circuitry coupled to said first and second electric heating elements;

first and second thermostats interposed in said electrical circuitry and being respectively operative to control the temperature of liquid in said upper and lower interior zones by respectively enabling current flow through said first and second electric heating elements via said electrical circuitry in response to sensed demands for heat in said upper and lower interior zones, said first thermostat being further operative to preclude current flow to said second electric heating element, via said second thermostat, until said first thermostat is satisfied; and dry fire protection apparatus operative to prevent electrical current flow through said first and second electric heating elements until said vessel is filled to a predetermined level with a liquid, said dry fire protection apparatus including:

a switch structure interposed in said electrical circuitry, said switch structure being openable to prevent electrical current flow from said electrical circuitry through said first electric heating element, and closable to permit electrical current flow through said first electric heating element, a switch closure member movable between a closed position in which it closes said switch structure, and an open position in which it opens said switch structure, a support structure operative to support a liquid-soluble member, in an undissolved state, in an exposed relationship with the interior of vessel and position the supported liquid-soluble member to maintain said switch closure member in said open position, and a force exerting structure operative to move said switch closure member to said closed position in response to the liquid soluble member being dissolved by liquid entering said vessel; and a sensing system operative to sense electrical current flow through said first electric heating element and permit electrical current flow from said electrical circuitry through said second electric heating element only during a sensed electrical current flow through said first electrical heating element.

46. An electric water heater comprising:

an empty vessel adapted to be filled with water to be heated;

an electric heating element extending into the interior of said empty vessel; and dry fire protection apparatus for preventing operation of said electric heating element until said empty vessel is filled with water to an extent immersing said electric heating element, said dry fire protection system including:

a switch structure through which electrical current may be flowed to said electric heating element, said switch structure having a closure member oriented in a switch-opening position and being movable to a switch-closing position, a water-soluble member exposed to the interior of said empty vessel adjacent said electric heating element and preventing movement of said closure member to said switch-closing position, and a force exerting structure operative to move said closure member to said switch-closing position in response to water contacting and dissolving said water-soluble member during filling of said empty vessel.

* * * * *